US006923667B1

(12) United States Patent
Chen

(10) Patent No.: US 6,923,667 B1
(45) Date of Patent: Aug. 2, 2005

(54) ROTARY ADAPTER

(75) Inventor: Jui-Chia Chen, Taipei (TW)

(73) Assignee: Acbel Polytech Inc., Taipei (TW)

( * ) Notice: Subject to any disclaimer, the term of this patent is extended or adjusted under 35 U.S.C. 154(b) by 0 days.

(21) Appl. No.: 10/983,182

(22) Filed: Nov. 6, 2004

(51) Int. Cl.[7] ..... H01R 29/00
(52) U.S. Cl. ..... 439/172
(58) Field of Search ..... 439/171, 172, 439/173, 177, 333

(56) References Cited

U.S. PATENT DOCUMENTS 5,613,863 A * 3/1997 Klaus et al. ..... 439/131
5,634,806 A * 6/1997 Hahn ..... 439/173
5,684,689 A * 11/1997 Hahn ..... 363/146
6,669,495 B2 * 12/2003 Philips et al. ..... 439/170

* cited by examiner

*Primary Examiner*—Thanh-Tam Le

(57) ABSTRACT

A rotary adapter comprises a main body, a fixing piece, and a plug. The main body further comprises: a circular recess containing a central platform; a plurality of first fastening portions spaced along the inner edge of the circular recess; and a channel formed with a positioning block and two symmetrical guide tracks disposed on respective banks thereof. The fixing piece is provided with a rail on each of two sides thereof corresponding to the guide tracks, and with a retaining portion arranged on one side of the fixing piece. The plug contains a circular base corresponding to the circular recess for the plug to rotate in the circular recess of the main body, in which a positioning receptacle at a position corresponding to the positioning cylinder is centrally formed in the circular base; a plurality of second fastening portions is arranged surrounding the circumferential edge of the circular base corresponding to the first fastening portions for buckling the plug with the main body; and a gap is defined in the circumference of the circular base of the plug and correspondent to the retaining portion of the fixing piece such that the plug can be fixed in the circular recess.

6 Claims, 4 Drawing Sheets

ROTARY ADAPTER

BACKGROUND OF THE INVENTION

1. Field of the Invention

The present invention relates generally to a plug structure, and more particularly to a portable rotary adapter provided for connecting parts having different sizes or designs on two sides, which is made extremely useful especially in travel.

2. The Prior Arts

It seems more often for people to recharge portable electric appliances, an electric razor, or a cellular phone, for example. Something that would bother a traveler very much is the non-unification of city electric power, in which either 110V or 220V is available; meanwhile, either a tripod plug or a bipod plug is required. Under such a situation, an adapter is always the best choice.

SUMMARY OF THE INVENTION

The primary object of the present invention is to provide a rotary adapter, which comprises a main body having a circular recess defined therein, a fixing piece, and a plug. The circular recess contains a central platform, which is provided with a positioning cylinder in center. A plurality of first fastening portions is spaced along the inner edge of the circular recess, and extended from one side of the main body to the circular recess, a channel is formed with a positioning block and two symmetrical guide tracks disposed on respective banks thereof. The fixing piece is provided with a rail on each of two sides thereof corresponding to the guide tracks to allow the fixing piece to slide back and forth in the channel, and with a retaining portion arranged on one side of the fixing piece, such that the fixing piece is slidable back and forth between the central platform and the positioning block. The plug contains a circular base corresponding to the circular recess for the plug to rotate in the circular recess of the main body, in which a positioning receptacle at a position corresponding to the positioning cylinder is centrally formed in the circular base; a plurality of second fastening portions is arranged surrounding the circumferential edge of the circular base corresponding to the first fastening portions for buckling the plug with the main body; and a gap is defined in the circumference of the circular base of the plug and correspondent to the retaining portion of the fixing piece such that the plug can be fixed in the circular recess and stopped.

Because of the characteristic of detaching the AC plug from the main body, the performance of small-quantity production or modular fabrication is possible.

For more detailed information regarding advantages or features of the present invention, at least one example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
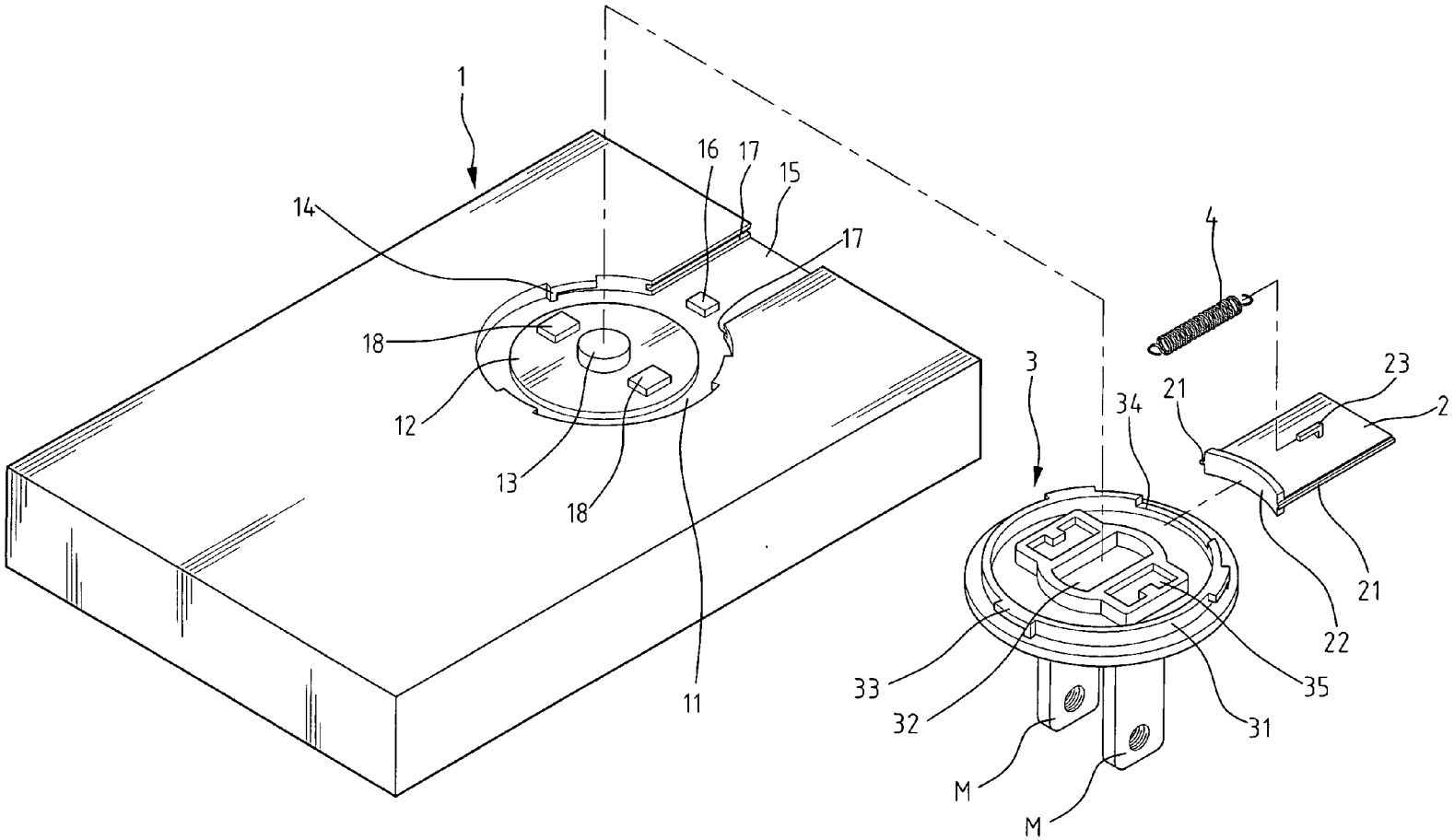
FIG. 1 is an exploded view of a rotary adapter of the present invention.
Figure 2:
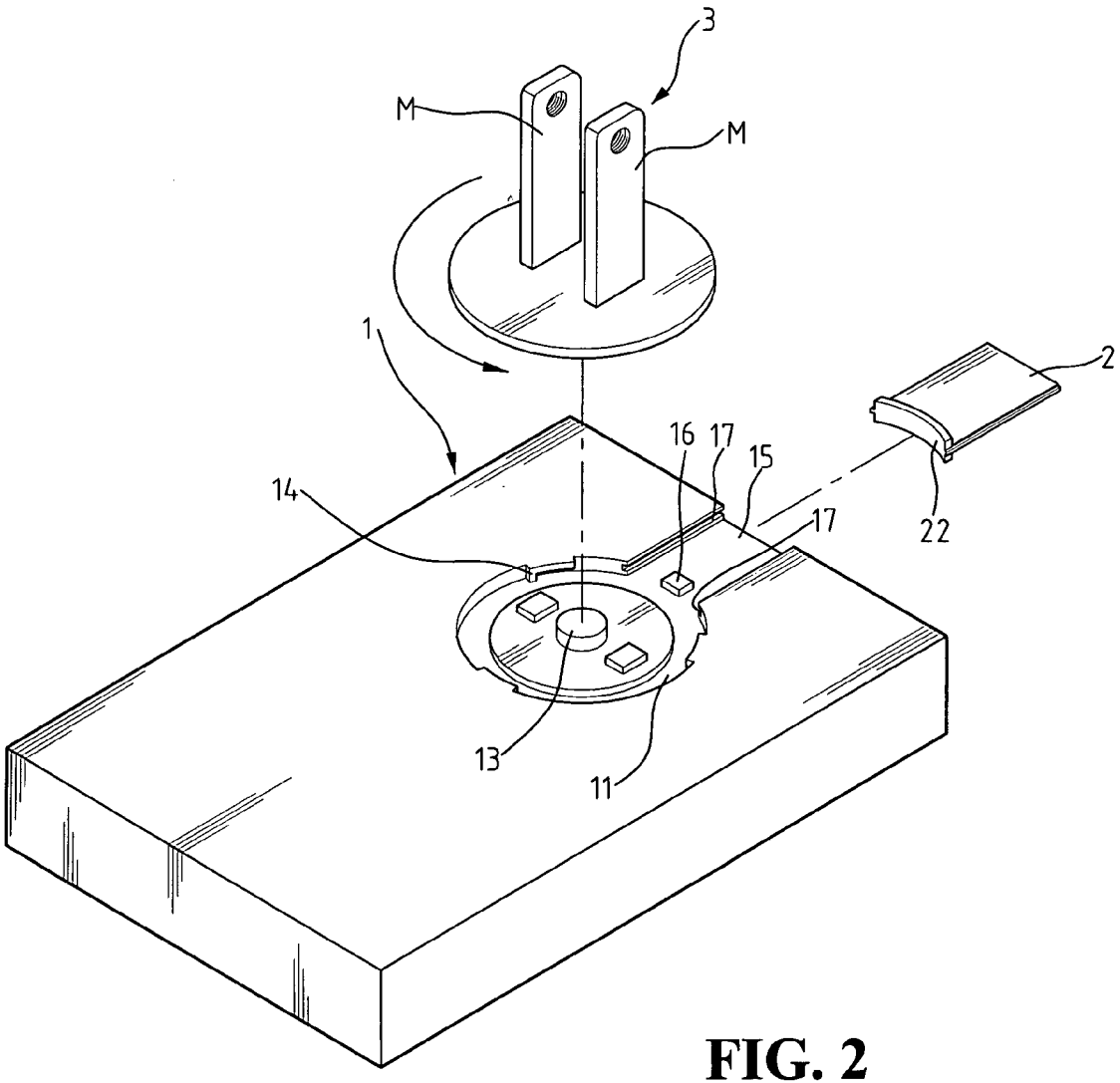
FIG. 2 is another exploded view of the rotary adapter of the present invention.

With reference to the drawings and in particular to FIGS. 1 and 2, a rotary adapter constructed in accordance with the present invention comprises a main body 1, a fixing piece 2, and a plug 3. The main body 1 further comprises a circular recess 11 having a central platform 12 provided with a positioning cylinder 13. The plug 3 contains a circular base 31 located correspondingly with the circular recess 11 of the main body 1, such that the circular base 31 can be rotated in the circular recess 11 of the main body 1.

A positioning receptacle 32 is located in the circular base 31 at a position corresponding to the positioning cylinder 13 of the main body 1, such that the plug 3 can be properly positioned when it is combined with the main body 1.

Along the inner edge of the circular recess 11 of the main body 1, a plurality of first fastening portions 14 is disposed, and along the circumference of the circular base 31 of the plug 3, a plurality of second fastening portions 33 is formed, in which the first fastening portions 14 and the second fastening portions 33 are set in positions corresponding to each other to allow the plug 3 to be buckled together with the main body 1, for example, along the counterclockwise direction indicated in FIG. 2.

One channel 15 is formed in the main body 1 by extending one side of the main body to reach the circular recess 11 thereof. A guide track 17 is formed on each of two sides of the channel 15 respectively and symmetrically. Also, two rails 21 are formed on one side each of the fixing piece 2 at positions corresponding to the guide tracks 17 such that the fixing piece 2 is slidable back and forth in the channel 15. Besides, a positioning block 16 is defined in the channel 15, and a retaining portion 22 is arranged on one side of the fixing piece 2 such that the fixing piece 2 is slidable back and forth between the central platform 12 in the main body 1 and the positioning block 16.

Moreover, in the fixing piece 2, a resilient member 4 supported by a supporting member 23 has its two ends each fixed at the supporting member 23 and the positioning block 16 of the main body 1 respectively, such that the fixing piece 2 is allowed to slide back and forth along the channel 15 elastically.

A characteristic of the present invention is that a gap 34 is defined in the circumference of the circular base 31 of the plug 3 and correspondent to the retaining portion 22 of the fixing piece 2. When the fixing piece 2 is pushed to reach a predetermined position, namely the position where the retaining portion 22 is engaged with the gap 34, the plug 3 is checked in the circular recess 11 of the main body 1 without rotation.

Figure 3:
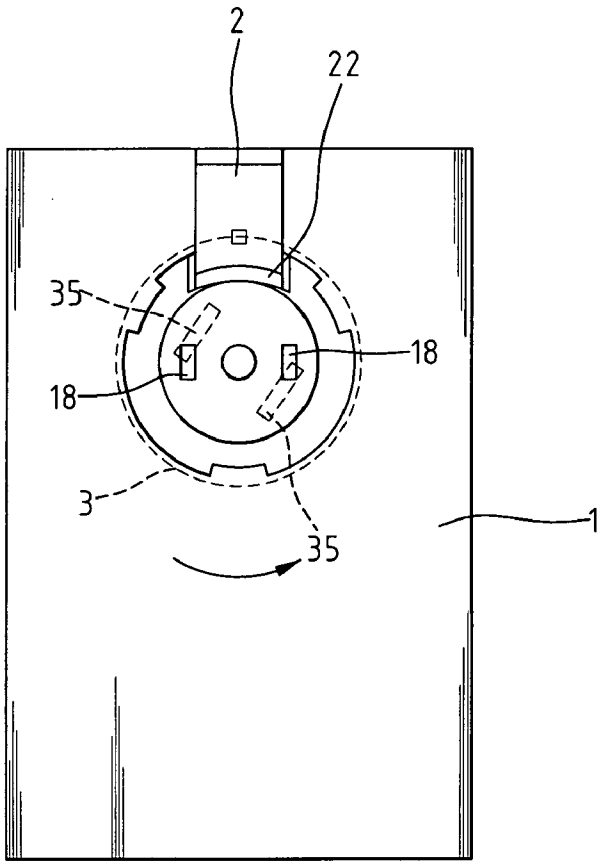
FIGS. 3 and 4 are schematic views showing the rotary adapter of the present invention under application.
Figure 4:
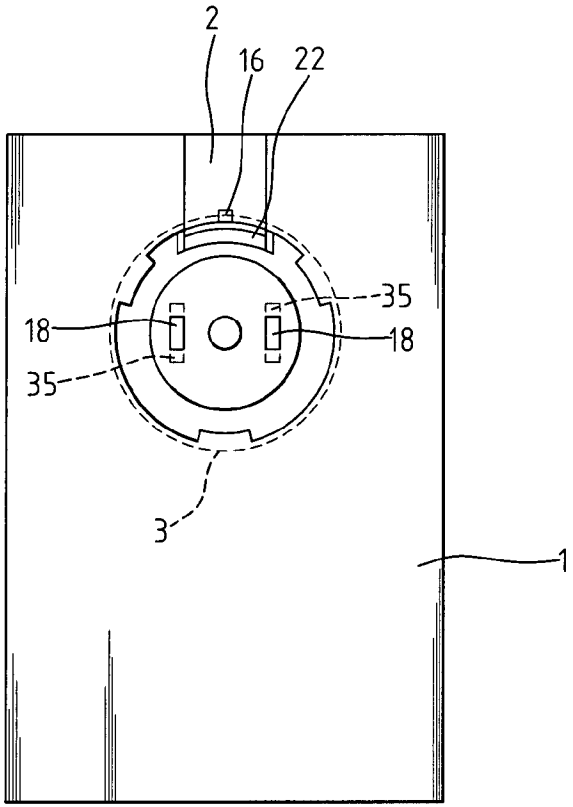

We would refer you this time to the application states shown in FIGS. 3 and 4. Suppose the fixing piece 2 is pushed first to approach the central platform 12 until its retaining portion 22 conflicts against the platform. At this moment, the circular base 31 of the plug 3 is put into the circular recess 11 of the main body 1 (as shown in FIG. 2) and turned along the arrow direction shown in FIG. 3 until the first and the second fastening portions 14, 33 are meshed one to one correspondingly and fixed axially. Then, the fixing piece 2 is released to return back to its initial position by means of the elastic force of the resilient member 4.

Yet, a plurality of appliance-contacts 18 is arranged on the central platform 12 of the main body 1, and also, a plurality of plug-contacts 35 is disposed on two sides of the positioning receptacle 32, therefore, the appliance-contacts 18 will contact the corresponding plug-contacts 35 to hence perform a metallic connection for use (shown in FIG. 4).

The trouble of carrying diversified plugs could be waived by using the present invention, which is meanwhile advantageous for small-quantity production, and because the AC plug can be detached from the main body, a modular fabrication is possible.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A rotary adapter, comprising:

a main body having a circular recess, in which one side of the main body is extended to reach the circular recess to form a channel provided with a guide track on each of two sides thereof;

a fixing piece, which is provided with two rails formed on one side each thereof at positions corresponding to the guide tracks such that the fixing piece is slidable back and forth in the channel, and provided with a retaining portion arranged on one side thereof; and a plug, containing a circular base located correspondingly with the circular recess of the main body such that the circular base can be rotated in the circular recess, in which and a gap is defined in the circumference of the circular base of the plug and correspondent to the retaining portion of the fixing piece such that the plug can be fixed in the circular recess and stopped.

2. The rotary adapter as claimed in claim 1, wherein the circular recess has a central platform provided with a positioning cylinder; the plug further contains a positioning receptacle located centrally in the circular base at a position corresponding to the positioning cylinder of the main body to thereby facilitate the combination of the main body with the plug.

3. The rotary adapter as claimed in claim 1, wherein the channel is formed with a positioning block for positioning the retaining portion such that the fixing piece can be located between the platform and the positioning block and moved back and forth.

4. The rotary adapter as claimed in claim 1, wherein a plurality of first fastening portions is spaced along the inner edge of the circular recess, and a plurality of second fastening portions is arranged surrounding the circumferential edge of the circular base corresponding to the first fastening portions for buckling the plug with the main body.

5. The rotary adapter as claimed in claim 1 further comprising a resilient member having two ends thereof fixed respectively at a supporting member of the fixing piece and the positioning block such that the fixing piece is elastically slidable in the channel back and forth.

6. The rotary adapter as claimed in claim 1, wherein a plurality of appliance-contacts is arranged on the central platform of the main body, and a plurality of plug-contacts is disposed on two sides of the positioning receptacle, therefore, the appliance-contacts will contact the corresponding plug-contacts in a metallic connection.

* * * * *